US005352017A

United States Patent [19]

Berning

[11] Patent Number: 5,352,017

[45] Date of Patent: Oct. 4, 1994

[54] MODULAR FURNITURE CONNECTING APPARATUS

[75] Inventor: Lloyd G. Berning, Hazel Green, Wis.

[73] Assignee: Flexsteel Industries, Inc., Dubuque, Iowa

[21] Appl. No.: 210,729

[22] Filed: Mar. 18, 1994

Related U.S. Application Data

[63] Continuation of Ser. No. 916,882, Jul. 20, 1992, abandoned.

[51] Int. Cl.[5] ..... A47C 15/00

[52] U.S. Cl. ..... 297/248; 297/440.1

[58] Field of Search ..... 297/440.1, 440.22, 232, 297/248, 249; 248/501, 502; 312/311

[56] References Cited

U.S. PATENT DOCUMENTS

| | | | |
|---|---|---|---|
| 1,514,418 | 11/1924 | Battenfeld | 297/440 X |
| 2,087,574 | 7/1937 | Kaufer . | |
| 2,656,550 | 10/1953 | Loeb | 297/440 X |
| 3,001,844 | 9/1961 | Spring | 312/111 |
| 3,393,011 | 7/1968 | Shastid | 297/440 |
| 3,614,157 | 10/1971 | Hendrickson | 297/248 |
| 3,620,567 | 4/1971 | Hendrickson | 297/248 |
| 3,697,130 | 10/1972 | Barecki et al. | 297/248 |
| 3,731,956 | 5/1973 | Hanley | 312/111 X |
| 3,877,764 | 4/1975 | Hiller, Jr. | 312/107 |
| 4,077,666 | 3/1978 | Heumann | 297/440 |
| 4,124,251 | 11/1978 | Petersen | 297/445 |
| 4,395,071 | 7/1983 | Laird | 297/440 |
| 4,400,031 | 8/1983 | DeDecker | 297/248 X |
| 4,826,117 | 5/1989 | Bastian et al. | 248/501 X |

FOREIGN PATENT DOCUMENTS

| | | | |
|---|---|---|---|
| 0336902 | 5/1921 | Fed. Rep. of Germany | 297/248 |
| 1279618 | 6/1972 | United Kingdom . | |
| 2103476 | 2/1983 | United Kingdom | 297/248 |

*Primary Examiner*—Kenneth J. Dorner
*Assistant Examiner*—Milton Nelson, Jr.
*Attorney, Agent, or Firm*—David C. Brezina

[57] ABSTRACT

An arrangement of pins and open-mouthed slots provide an apparatus for interconnecting furniture modules to form a sectional sofa in order to enable rapid and easy blind connection, while permitting both ease in disconnection and elimination of stresses on the frames of adjoining sections, through the camming and interlocking action between pins and slots on rails on the respective adjacent modules.

14 Claims, 3 Drawing Sheets

MODULAR FURNITURE CONNECTING APPARATUS

This application is a continuation of application Ser. No. 07/916,882, filed Jul. 20. 1992 and now abandoned.

BACKGROUND OF THE INVENTION

Modular seating arrangements or sectional sofas combining plain chair-type units, beds, curves, and recliner units to form a sofa-like arrangement have become increasingly popular. Because of differences in construction of a chair unit and a recliner unit and the mixing of various modules, in combination with the substantial weight of the completed sectional sofa unit, the joinder of separate modules into a single unit has been a problem heretofore not effectively solved.

A reclining mechanism is often spring loaded and includes footrest raising, seat sliding, back support pivoting, and head rest elevation, and has various anchor points, pivots and spring fastening locations on a frame. Accordingly, recliners typically include a metal frame. Similarly, chair beds use a retracting bed spring mechanism and folding mattress, also having linkage and pivots and a metal frame.

The forces [imposed] caused by movement of the entire assembly combine over the life of the sectional sofa and impose either great strains on components such as a wooden frame of an adjacent module, or cause misalignment of the reclining mechanism itself when adjacent modules resist flexing of the typically steel framework of the reclining mechanism.

Typical prior art solutions include use of complex, high-strength connectors to [impose] make a rigid connection between all elements. This has disadvantages in complexity and the added strength requirements for the component parts, or need for providing a high-strength frame, such as a steel frame, for all components. Additionally there are also potential disadvantages in difficulty of disassembly, added cost, and added weight. The loads imposed by lifting the end of a sectional sofa unit cause flexing, thereby misaligning the reclining mechanism, or causing other difficulties.

DESCRIPTION OF RELATED ART

Sectional sofas are generally known, but effective interconnection of individual modules has been a problem since at least the 1930's. Various attempts at solving the problem have proven either ineffective, unduly complex, or have created additional problems.

Rigid connections either require massive components and frames or result in distortion of lighter weight frames and misalignment when mechanisms are operated. These are therefore inappropriate or inefficient to manufacture, ship and use by the end user.

Light duty interconnections with pins elevated substantially above the floor and engaging [angles] angled slots have been used between such things as nesting or folding chairs used primarily in school, church, club or other institutional settings. These do not adapt to upholstered modules or motion modules where mechanisms are used. The weight of sectional sofa modules, the loads imposed by mechanisms and the need for blind connection render light duty interconnections ineffective.

SUMMARY OF THE INVENTION

The present invention uses specially fabricated brackets with pins and slots having aligning receptacles to maintain relative module position in requisite directions of motion while providing ease of connection and disconnection and minimizing damage or misalignment of frames during transport, or furniture rearrangement. The interlocking pins and slots limit unwanted front to rear and separation movement of modules. By using the disclosed arrangement modules are easily aligned and attached or detached at a position where loads on the structure can be controlled, and by enabling ready detachment, stresses created by frame twisting imposed by prior art structures can be avoided. The invention departs from prevailing art in the sectional sofa field in its use of specifically designed interlocking pins and slots having optimal geometry which enable the connection of upholstered modules to assemble a completed sectional sofa arrangement.

Typical standard chair units and recliner units are bulky, heavy, and in use impose stresses on their own frame, and in prior art embodiments, adjacent units. Using brackets located at the bottom outboard corners of the modules having the invention with respectively projecting pins with enlarged heads and slotted flanges, the modules can be readily assembled and disassembled for whatever desired reason. This enables transportation, storage, rearrangement of furniture, or addition, subtraction, or reorientation of various modules to reconfigure the entire sectional sofa and provide the owner with the ultimate in flexibility and variety of furniture arrangements. The same advantages greatly facilitate manufacturing assembly lines, warehousing, shipping and display in a retail environment, all of which provide significant advantages.

The present invention addresses the shortcoming of prior art arrangements by concentrating strength where it is needed, providing ease of alignment and disassembly, and avoiding rigidity where it is not needed by virtue of the unique construction described herein.

DETAILED DESCRIPTION OF THE PREFERRED EMBODIMENT

Figure 1:
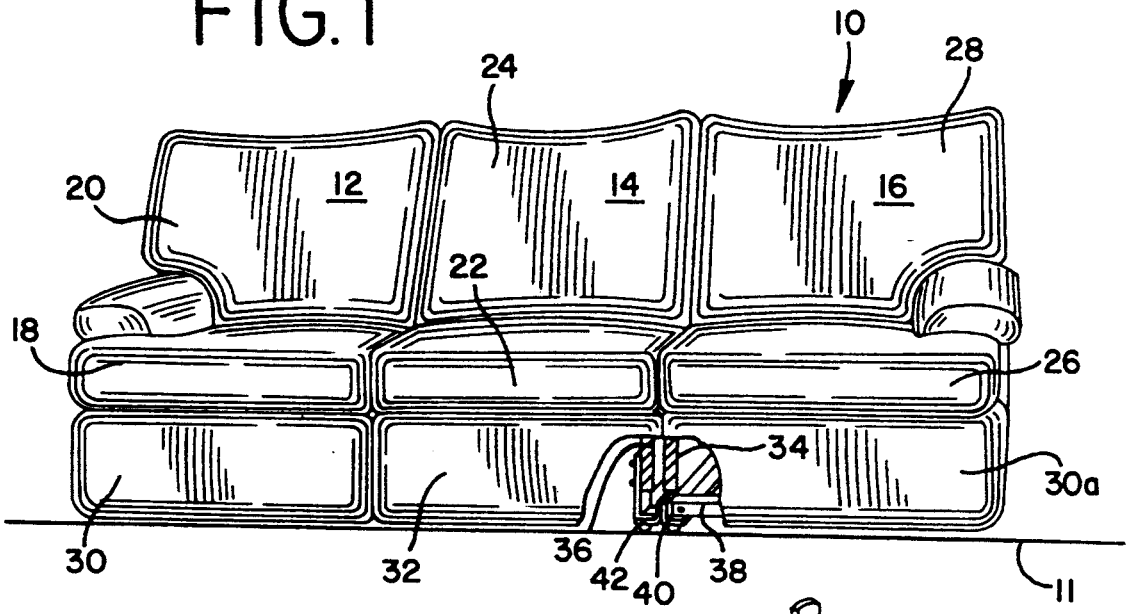
FIG. 1 is a perspective view of a sectional sofa cut away in part to show the invention joining two modules.

A sectional sofa 10 is supported on a floor or surface 11. The sofa 10 is comprised typically of a combination of modules including a recliner module 12 and chair module 14 and second recliner module 16 which can be configured in various combinations to form a sectional sofa 10 of any desired configuration and selected length.

In the preferred embodiment, the recliner module 12 has a recliner seat 18 and back 20. Fixed chair module 14 also includes a seat 22 and back 24, as does second recliner module 16 having seat 26 and back 28. Various modules can be combined such as armless chair, one arm chair, one arm bed, ninety degree bend and recliner chair modules. The principles taught herein apply to chair and ninety degree bend modules equally, and to recliner and chair bed mechanisms equally. It is important that each module be aligned so that the respective seats 18, 22 and 26, and backs 20, 24 and 28, are aligned to form a substantially continuous seat plane and a substantially continuous back plane so that the appearance of the individual modules is equivalent to an ordinary single frame sofa. Nevertheless, combining recliner modules 12 and 16 with fixed chair module 14, whether in the configuration shown or in alternative configurations, as where a plurality of chair modules could be used, or armless rather than one arm recliner modules, the entire sectional sofa 10 is subject to conflicting design goals of maintaining the desired relationship between the seats 18, 22 and 26, and backs 20, 24 and 28, enabling smooth operation of the mechanism while providing for movement of the sectional sofa 10 through the manufacturing plant, in storage and shipment, in store displays, while moving into and out of, the home or office in which it is ultimately used, and for rearrangement in the places in which it is used.

The recliner mechanism pivots foot members 30, [32,] 30*a* tilts seat members 18, 26, and pivots and lowers back members 20, 28. Sofa sleeper and chair beds can also be adapted for use in sectional sofa modules. All of these types of modules are referred to as mechanism modules. Cycling such a mechanism, however, necessarily imparts substantial loads upon a frame 34 and side members 36 due to concentrations of loads at pivot points, spring loading to maintain an upright position, toggling to lock in a reclined position, and a substantial lever arm imposed when closing by downward pressure on the foot 30. Because of the loads imposed, typically the frame 38 for a recliner module 12 is made of steel, while frames for [non-mechanism or] chair modules, such as side member 36 of module 14 can be wood. The term chair module, as used herein, refers to any plain, or non-mechanism module, with a seat and a back, as opposed to a module with a mechanism, such as a chairbed or a recliner chair.

The connection of differing modules 12, 14 and 16 into a single sectional sofa 10 thereby imposes unique requirements on a connecting apparatus. The connecting apparatus must have adequate strength to maintain the relative position of the modules 12, 14 and 16, preventing movement in undesired directions such as side to side movement causing separation along a longitudinal axis, or front to rear sliding when one module is sat upon. A connecting apparatus further must be readily detachable and readily attachable, both for commercial reasons such as efficient handling, shipping and storage, as well as ease of display or reconfiguration in a store, and finally, ease in moving and attachment when placed in a home, office, or other destination, while still permitting detachment for rearrangement or cleaning. This goal must then be coupled with the goals minimizing stress concentrations in a framework which can cause twisting and misalignment of frame members such as the recliner frame 38, or the mechanism.

Figure 2:
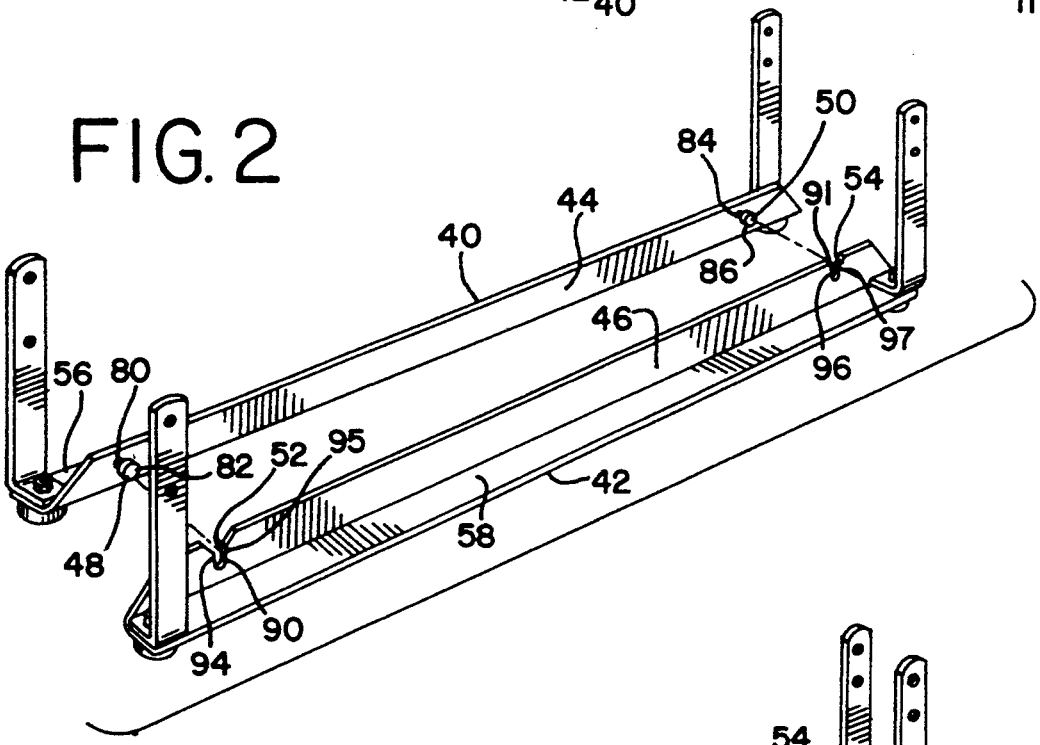
FIG. 2 is a perspective showing the connector assembly of the invention with its two elements in a separated condition.
Figure 3:
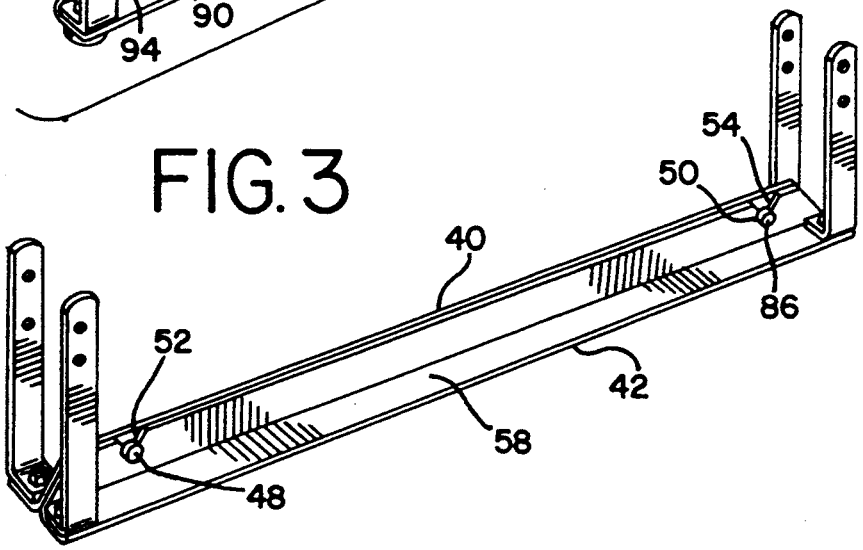
FIG. 3 is a perspective showing the connector assembly of FIG. 2 with its two elements in a connected condition.

A first rail 40 shown in FIG. 2 has a plate or member, preferably a flange 44 aligned substantially vertically and extending substantially the length of the rail, corresponding to the depth from front to back of a module. The adjacent module has a second rail 42 having a corresponding vertically aligned and front to rear extending member or plate, also preferably a flange 46. In flange of the preferred embodiment, as do flanges typically, terminates in a rim (shown, but not numbered). One feature in operation of the instant apparatus is the placement of the rails 40 and 42 at the lowermost and outboard corners of the respective adjacent modules 14 and 16. This placement and the configuration utilized as will be more fully explained, optimizes various aspects of the invention when in operation[s]. The apparatus can be easily attached or detached generally, and can specifically be readily attached by "feel" even when the rails are substantially hidden by frames and upholstery, it provides for reliable and repetitive attachment, it limits unwanted movement, both separation and front to rear movement, yet it permits sufficient slight twisting during the cycling of a recliner mechanism, or alternatively, upon manual movement of a recliner module 12 or 16, shown here at opposite ends of sofa 10, so that the reclining mechanism is effectively isolated and can operate independent of the intermediate adjacent module 14.

The connector apparatus uses a projecting front pin 48 which, when the modules are placed in a desired position, engages a front slot 52. The front pin and front slot described are placed near one end of the respective rails 40 and 42. A corresponding rear pin 50 and rear slot 54 is located near the opposite end of the respective rails 40 and 42.

Rail 40 and rail 42 are of generally L-shaped section and when joined lie substantially parallel to one another. At the lower portion of the respective flanges 44 and 46 each merges into a first horizontal flange 56 and second horizontal flange 58. The respective first and second horizontal flanges 56 and 58 extend away from one another inwardly with respect to each module. The horizontal flanges 56 and 58 generally extend in a plane parallel to the floor 11 on which the sectional sofa 10 is placed.

Figure 4:
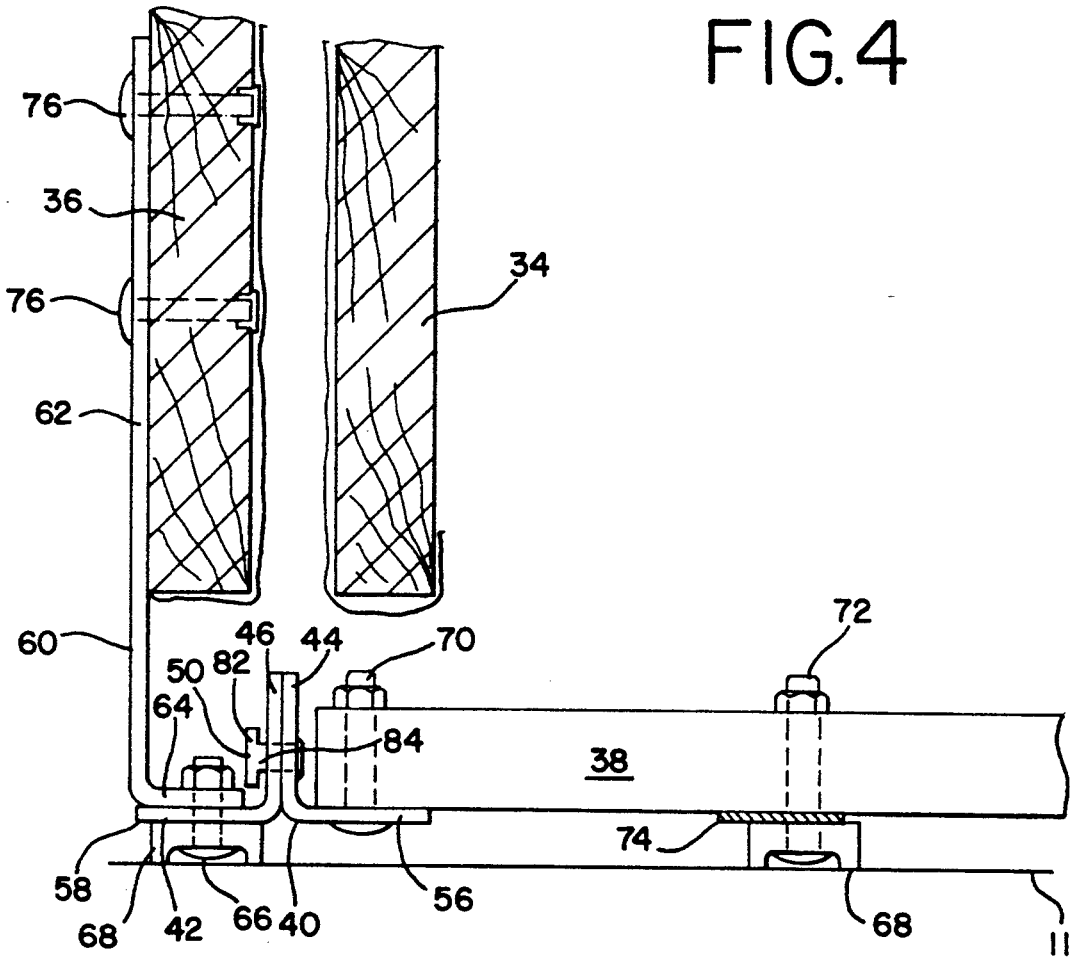
FIG. 4 shows the interconnection between a chair module on the left and a reclining chair module on the right.

Front pin 48 is comprised of a projecting body, having a cylindrical portion 80, and at the end of that cylindrical portion 80 is an enlarged head 82 in the manner of a rivet, as shown in FIG. 4. Rear pin 50 has corresponding cylindrical portion 84 and head 86.

Pins 48 and 50 project substantially perpendicularly to the first vertical flange 44. Front slot 52 and rear slot 54 are formed in the second vertical flange 46 so that when the respective modules, having the rails mounted thereon, and specifically the flanges 44 and 46, are moved in proximity and the module having rail 40 is raised slightly, longitudinally and horizontally aligned and lowered, the pins slide downwardly to the slots. Pins 48 and 50, when fitted in slots 52 and 54, respectively, resist front to rear movement along the longitudinal axis of first flange 44 relative to second flange 46 by virtue of the resistance of cylindrical portions 80 and 84 fitting in front receptacle 90 and rear receptacle 91 of front slot 52 and rear slot 54, respectively.

The receptacles 90, 91 are defined by vertical walls 94, 95 and 96, 97 as shown in the drawings. The connecting apparatus resists lateral movement or separation of modules by the engagement of pins 48 and 50 with the adjacent portions of second flange 46.

Figure 5:
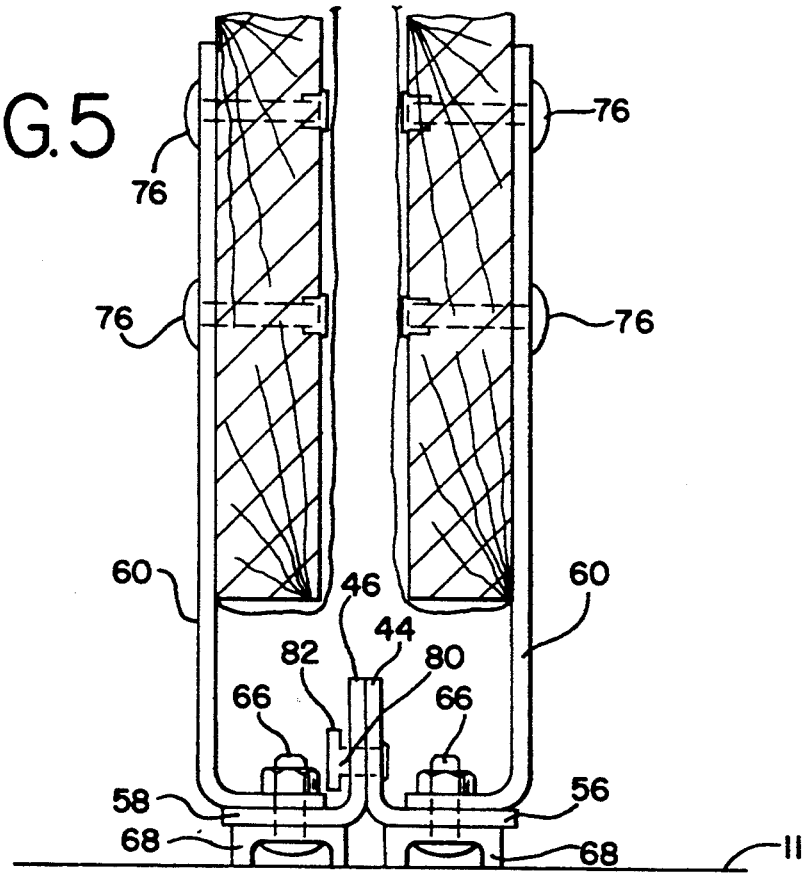
FIG. 5 shows the connection between two chair modules.

In the preferred embodiment the entire structure is supported on floor or surface 11 by one or more feet or glides 68 mounted on the rail 42 with a fastener 66. These are shown in FIG. 4 and FIG. 5.

Two alternative mounting structures are shown in FIG. 4. These are used and are adapted to the specific module, such as a chair module 14 or recliner module 12, 16. In attachment to chair module 14, upstanding brackets 60 have an upright 62 and mounting ear 64 fastened to the respective rails 40, 42. Ear 64 can be mounted using fastener 66 to the horizontal flanges, 56 and 58, in the preferred chair module embodiment. The upright 62 is attached to the frame 34 of a wooden chair module 14, using fasteners 76. The fasteners can be any combination of studs, bolts, screws, rivets, or other known fasteners. Adaptation of the rails can be made using brackets to fasten joint combinations or connecting units to the frames of the modules as previously described.

Recliners and chair beds include both wooden frames 34 and interconnected metal frame 38. In the instant embodiment, the foot or glide 68 supports metal frame 38 and is attached thereto with a fastener 72. In the preferred embodiment, a spacer 74 shown in FIG. 4 can be used to assure common height of the respective modules 12, 14, 16. Fastener 70 affixes the end of frame 38 to horizontal flange 56 thereby providing a rigid connection between rail 40 and frame 34 which receives loads imposed by movement of the adjacent module on metal frame 34 adjacent the floor.

In the preferred embodiment arranging the rails 40, 42 so the first rail 40 with pins 48 and 50 is on one side of the module and the second rail 42 with slots 52 and 54 on the other side, provides advantages in adaptability to different modules and addition of more modules. While in the preferred embodiment all pins are shown on the left side and all slots are shown on the fight side, this is not mandatory. The invention need not be limited to such an arrangement and there may be operational considerations such as the weight of a certain type of module that would require or be advantageously served by a different arrangement. For example, all modules having mechanisms could have pins, on their rails and all modules being of the plain chair type slots, or vice versa. This would preclude placing incompatible mechanisms together by requiring an intervening all-slot chair module.

Figure 6:
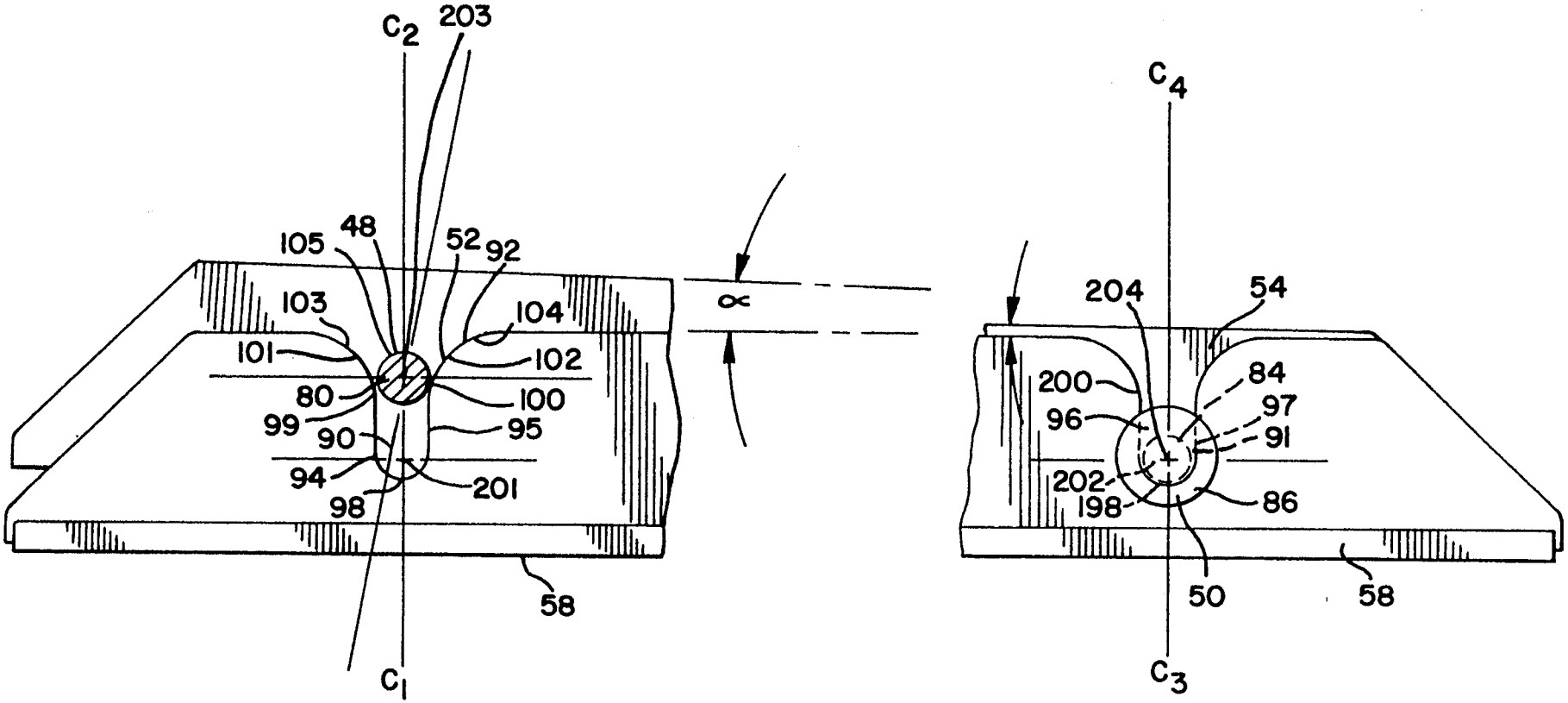
FIG. 6 is an fragmented elevational view of two engaging rails.

In the preferred embodiment it has been determined that the specific geometry of the connectors is an important and novel feature and is illustrated in FIG. 6. When the modules are connected, pin 48 fits in slot 52 with cylindrical portion 84 generally abutting bottom arc 98. The slot 52 is more particularly defined as having a receptacle 90 between wall 94 and 95. Opposed vertical walls 94 and 95 extend upward from bottom arc 98. At the top of the walls 94 and 95 shoulders 99 and 100 are formed and merge into surfaces 101, 102. These surfaces then diverge outwardly and upwardly into curved camming edges or surfaces 103, 104, thereby defining a downwardly converging mouth 105 directing pin 80 to receptacle 90. The geometry of the rear receptacle 91 is similar to that of front receptacle 90.

This detailed geometry of slot 52 facilitates connection of large, heavy modules even when the interconnection is made blind, as when concealed by the sides of the module and upholstery affixed thereto, which is designed to butt together with the upholstery of an adjacent module.

Modules 12, 14 and 16 are generally large and heavy, therefore unwieldy, and the connection between them is made blind, such as when obscured by the structure and the abutting upholstery. Since it is desirable for all structural elements to be concealed in a sectional sofa 10, the specific structure of the connector mechanism provides significant advantages in fitting the modules together. In connecting separate modules together, it is substantially easier to engage a single pin with the modules at a relative angle to one another and reduce the angle until connection of each pin 48, 50 with the respective slot 52, 54.

Several other properties of the invention has been determined to deliver a performance advantage. Spacing the pin/slot joint combinations 48, 52, a first connecting unit and 50, 54, a second connecting unit, apart from one another and close to the ends of the rails maximizes the stability of the sectional sofa assembly 10. Furniture is often placed on uneven or soft surfaces such as carpets which render designing an interlocking mechanism which is effective yet simple to operate and manufacture a technological problem. Placement near the ends maximizes stability. A wider track is more stable than a narrower one. The arrangement taught in the invention reduces the lever arm applied to each pin and slot joint combination 48, 52 or 50, 54 of the connection when lifting of one end of the sofa 10 occurs.

Another property in the invention is the height of the flanges. The relationship of total height of flanges 44 and 46 relative to the distances from the top of the flanges to the centers 201, 202 of pins 48 and 50 and the centers 203, 204 of the arcs 98, 198 is illustrated in FIG. 6. The depth of the slots is more than half the height of the flanges. By having a flange whose height is substantially less than twice the length of the slot from arc 98 to mouth 105, the pin must travel more than half the height of the flange 46 in order to disengage. On uneven or soft surfaces, this provides improved security in the engagement since, for example, merely sitting on one module on a carpet will not cause a sufficient displacement by compression of an underlying carpet to cause the modules to become disengaged.

Finally, the geometry of the slot shapes and the distance between pin centers 201, 202, and arc centers 203, 204 also provides advantageous properties. The dimensions between front and rear pins 48 and 50 and front and rear slots 52 and 54 are such that angle alpha is formed while modules are being moved to be rearranged. When cylindrical portion 84 of rear pin 50 abuts rear arc 198 front pin 48, as angle alpha is increased, front pin 48 will cam against wall 95 to shoulder 100 and inner camming surface 102 until release.

Shoulder 100 provides resistance against release because while the distances between centers 201, 202 and 203, 204 are the same, the center 202 to shoulder 100 distance is slightly larger. This provides a tactile indication of alignment and detachment particularly useful in connecting modules blind. The diameter of cylindrical portions 80 and 84 and the clearances between receptacle walls 94, 95 and 96, 97 are such that the camming action at shoulder 100 slightly displaces pin center 202 from arc center 204 or, if the modules be tilted the opposite way, (not shown) pin center 203 from arc center 201 by camming at shoulder 200.

The use of the converging edges 102, 103 imparts a centering action by camming engagement with the cylindrical surface of cylinder portion 80. This provides advantages in the blind connection of modules which could be accomplished by equivalent structures placing the converging edges on the pin, as in a triangular or keystone shaped pin or projecting flange, while having walls or camming surfaces in the other rail effectively being vertical substantially the entire height of the slot 52. In these alternatives there would nevertheless be a projecting member like the front pin 48, converging edges such as edges 102, 103 and a receiving member such as the slot 52, although the converging surfaces could be placed on the projecting member.

Various features of the invention have been particularly shown and described in connection with the illustrated embodiments of the invention, however, it must be understood that these particular arrangements merely illustrate, and that the invention is to be given its fullest interpretation within the terms of the appended claims.

In accordance with my invention, I claim:

1. A connecting apparatus for joining furniture modules for securement adjacent one another on a surface comprising:

a substantially vertically aligned and longitudinally extending first plate mountable to the bottom of and near one side of a first furniture module;

a substantially vertically aligned, substantially horizontally and longitudinally extending second plate for extending parallel to said surface and being mountable to the bottom of and near one side of a second furniture module;

a first pin projecting outwardly from said first plate toward said second plate; and a vertically disposed and vertically upwardly opening first slot formed in said second plate for receiving said first pin in connected relationship, thereby limiting relative movement between said modules to movement substantially along their vertical axes;

said second plate having a substantially horizontally and longitudinally extending rim merging into said first slot for guiding said pin to said slot.

2. The connecting apparatus of claim 1 and said first pin further comprising:

a cylindrical portion projecting normally from said first plate; and an enlarged head formed at the end of said cylindrical portion, and forming the end of said first pin, and spaced from said first plate.

3. The connecting apparatus of claim 1, said first slot having edges defining a receptacle with a substantially vertical axis, an open mouth and a bottom arc;

said edges having a pair of opposed substantially vertical walls and a pair of camming surfaces, said walls and camming surfaces joining at a shoulder.

4. The connecting apparatus of claim 1 wherein:

said apparatus is adapted for connecting a first furniture module to a second furniture module;

said first pin and said first slot when joined with said modules are located near the front of said first and second modules thereby forming a first joint combination; and a second joint combination of a second pin and a second slot located near and mountable to the rear of said first and second modules, said second pin and said second slot being formed and arranged to engage one another in the manner of said first pin and first slot.

5. The connecting apparatus of claim 1 further comprising:

a first horizontal flange formed and arranged to extend substantially normally inwardly from said first plate;

a first frame mountable to said first horizontal flange;

a bracket mounting said first horizontal flange to said first frame; a second horizontal flange formed and arranged so as to extend substantially normally inwardly from said second plate;

a second frame being mountable to said second horizontal flange; and said second horizontal flange being directly fastened to said second frame.

6. The connecting apparatus of claim 5 and said pin further comprising:

a cylindrical portion projecting normally from said first plate; and an enlarged head formed at the end of said cylindrical portion and spaced from said first plate.

7. The connecting apparatus of claim 6, said first slot further comprising:

edges defining a receptacle with a substantially vertical axis, a mouth and a bottom arc;

said first slot being adapted to slidingly receive said cylindrical portion of said pin in said receptacle in abutment with said arc; and said edges being symmetrical about said substantially vertical axis and said mouth camming said cylindrical portion toward said substantially vertical axis.

8. The connecting apparatus of claim 7, said first slot further comprising said edges having a pair of opposed substantially vertical walls and a pair of camming surfaces, said walls and camming surfaces joining at a shoulder.

9. A connecting apparatus for joining furniture modules for placement adjacent one another on a floor comprising:

a substantially vertically aligned and longitudinally extending first plate extending substantially horizontally and mountable to the bottom of and near one side of a first furniture module;

a substantially vertically aligned and longitudinally extending second plate extending substantially horizontally and mountable to the bottom of and near one side of a second furniture module;

a first pin projecting outwardly from said first plate toward said second plate; and a vertically oriented first slot for receiving said first pin in locking relationship, being formed in said second plate, said locking relationship limiting relative movement between said modules to movement substantially along their vertical axes;

said slot further having a top opening mouth for receiving said first pin;

said second plate further having a substantially horizontally longitudinally extending rim configured to engage and direct said pin to said mouth.

10. The connecting apparatus of claim 9 further comprising:

a first base flange being formed integrally with and extending substantially normally inwardly from said first plate;

said first module having a first frame being mountable to said first base flange;

a bracket mounting said first plate to said first frame when said module is of a standard chair type and said first plate being directly fastened to said first frame when said module is of a non-chair type;

a second base flange being formed integrally with and extending substantially normally inwardly from said second plate;

said second module having a second frame being mountable to said second base flange; and a second bracket mounting said second base flange to said second frame when said module is of a chair type and said second base flange being directly fastened to said second frame when, said module is of a non-chair type.

11. The connecting apparatus of claim 9 and said first pin further comprising:

a cylindrical portion mountable on and projecting normally from said first plate; and an enlarged head being at the end of said cylindrical portion, thereby forming the end of said first pin and spaced from said first plate.

12. A connecting apparatus for joining furniture modules for securement adjacent one another on a surface comprising:

a substantially vertically aligned and longitudinally extending first plate mountable to the bottom of and near one side of a first furniture module;

a substantially vertically aligned and longitudinally extending second plate for extending parallel to said surface and being mountable to the bottom of and near one side of a second furniture module;

a first pin projecting outwardly from said first plate toward said second plate; and a vertically disposed and vertically upwardly opening first slot formed in said second plate for receiving said first pin in connected relationship, thereby limiting relative movement between said modules to movement substantially along their vertical axes said second plate having a top rim for slidingly and cammingly engaging said pin;

said first slot having edges defining a receptacle with a substantially vertical axis, an open mouth and a bottom arc;

said first slot being adapted to slidingly receive said cylindrical portion of said pin in said receptacle in abutment with said arc; and said edges being symmetrical about said substantially vertical axis and said mouth camming said cylinder portion toward said substantially vertical axis, and said edges merging with said top rim so that said pin can be slidingly and cammingly engaged into said mouth.

13. A modular furniture connecting apparatus for connecting a first and a second module supported on a surface comprising:

means for pinning engagement of said first module;

means for slidingly receiving said pinning means on a rim formed in said second module so that said pinning means are slidingly movable on said rim to an open mouth and then into a slot in which relative movement between said first and second modules is limited to substantially vertical movement;

first means for mounting said pinning means on said first module;

means for framing said first module defining a structure of said first module;

said first mounting means further supporting said first module framing means in a selected position relative to said surface;

second means for mounting said receiving means on said first module;

means for framing said second module defining its structure;

said second mounting means further supporting said second module framing means in a selected position relative to a surface; and said first mounting means and said second mounting means being adapted to support mechanism framing means and chair framing means in accordance with the strength and flexibility parameters of the respective choice of framing means.

14. The modular furniture connecting apparatus of claim 13 further comprising:

said pinning means further comprising a cylindrical pin with an enlarged head; and said receiving means further comprising a generally symmetrical substantially vertically aligned slot having a receptacle and a converging mouth for directing said pin into said receptacle.

* * * * *